US006546653B1

(12) United States Patent
Thibodeaux, Jr.

(10) Patent No.: US 6,546,653 B1
(45) Date of Patent: Apr. 15, 2003

(54) DOOR SIGN

(76) Inventor: Larry J. Thibodeaux, Jr., 1337 Nursery Pl., Metairie, LA (US) 70005

( * ) Notice: Subject to any disclaimer, the term of this patent is extended or adjusted under 35 U.S.C. 154(b) by 0 days.

(21) Appl. No.: 09/556,609

(22) Filed: Apr. 21, 2000

(51) Int. Cl.[7] ..... G09F 23/00

(52) U.S. Cl. ..... 40/599; 40/617; 40/672; 40/673

(58) Field of Search ..... 40/331, 599, 490, 40/672, 673, 617, 124.09, 124.12; D20/22, 42; 292/288, 289, 346, DIG. 2; 70/63, 417

(56) References Cited

U.S. PATENT DOCUMENTS

| | | | | | |
|---|---|---|---|---|---|
| 180,894 | A | * | 8/1876 | Leach | 70/448 |
| 740,228 | A | | 9/1903 | Carpenter | |
| 1,272,394 | A | * | 7/1918 | Devney | 40/331 |
| 1,276,735 | A | | 8/1918 | Devney | |
| 1,329,937 | A | * | 2/1920 | Sweterlitsch | 40/673 |
| 1,483,333 | A | * | 2/1924 | Capece | 70/451 |
| 2,756,525 | A | * | 7/1956 | Greenberger | 40/315 |
| 3,065,946 | A | * | 11/1962 | Berkow | 248/317 |
| 3,666,309 | A | * | 5/1972 | Zarzycki et al. | 292/337 |
| 3,673,605 | A | * | 6/1972 | Allenbaugh | 292/346 |
| 4,216,598 | A | | 8/1980 | Newbert | |
| 4,498,694 | A | * | 2/1985 | Warwick | 292/1.5 |
| 4,545,521 | A | * | 10/1985 | Hiersteiner | 229/68.1 |
| 4,823,571 | A | * | 4/1989 | O'Gara | 70/139 |
| 4,862,617 | A | | 9/1989 | Cooke, Jr. | |
| D316,877 | S | | 5/1991 | Mitchell | |
| 5,076,626 | A | * | 12/1991 | Tiddy et al. | 292/1 |
| 5,249,380 | A | * | 10/1993 | Fast | 40/672 |
| 5,269,100 | A | * | 12/1993 | Fontenot | 49/460 |
| D408,859 | S | * | 4/1999 | Ho | D19/78 |
| D429,286 | S | * | 8/2000 | Luciani et al. | D20/42 |

* cited by examiner

*Primary Examiner*—William L. Miller
(74) *Attorney, Agent, or Firm*—Kenneth L. Tolar

(57) ABSTRACT

A door sign includes spaced front and rear panels with a side panel perpendicularly disposed therebetween. Both the front and rear panels each include an angularly extending slot for accommodating a door knob shaft. The side panel includes an elongated opening for receiving the door knob latch and possibly a dead bolt latch if the door is so equipped. The sign is positioned such that the door knob shafts are within the angular slots and the door knob latch is protruding through the side panel opening. If the door is closed and locked, the sign cannot be removed without unlocking and opening the door thereby preventing tampering or removal by unauthorized passers by.

3 Claims, 4 Drawing Sheets

DOOR SIGN

BACKGROUND OF THE INVENTION

The present invention relates to a door sign designed to prevent removal or tampering by unauthorized persons.

DESCRIPTION OF THE PRIOR ART

Door signs have long been used to display messages, particularly in hotels, offices and various commercial establishments. The most common door sign typically includes a panel having a predetermined message on one or both sides thereof. The panel will usually contain a large aperture for receiving the door knob so that the panel can be suspended from the door knob shaft. Various door signs exist in the prior art which are intended to improve the conventional door sign described above. Most of the improvements are directed at preventing wind or other similar minor forces from displacing the sign from the knob shaft. For example, U.S. Pat. No. 4,862,617 issued to Cooke, Jr. et al discloses a message carrying device primarily designed as a key ring holder. The device includes a planar body portion having a restrictive passageway communicating between a central opening and an opening along the edge of the body for receiving a portion of a key ring or similar device.

U.S. Pat. No. 4,216,598 issued to Newbert discloses a wind-proof door knob sign including a standard tag having an aperture dimensioned to receive a typical door knob and a door knob shaft aperture in communication therewith. Between the door knob shaft aperture and the door knob aperture are flexible, integral detent tabs that are displaced outwardly from the tag as it is slid over the knob shaft. Once the tag is appropriately installed, the tabs snap back to their original position beneath the door knob shaft to secure the tag to the door.

U.S. Pat. No. 1,276,735 issued to Devney relates to a door sign including a door knob opening having a pair of flaps extending thereacross. When a door knob is inserted into the door knob opening, the flaps separate and move outwardly away from the knob allowing it to pass therebetween. Once the door knob passes completely through the opening, the flaps return to their original position beneath the door knob shaft.

U.S. Pat. No. 740,228 issued to Carpenter relates to a card having an arcuate incision at the lower edge thereof for receiving the upper portion of a door knob shaft.

U.S. Pat. No. Des. 316,877 issued to Mitchell discloses an ornamental design for a card holder.

The primary disadvantage associated with the conventional door signs described above is that, because they must be hung from the external door knob, they may be easily removed by passers by. The present invention provides a uniquely designed door sign that wraps around the door and is secured to both the internal and external door knob such that, when the door is closed and locked, the sign cannot be removed. Furthermore, the sign includes a variable message display means allowing a user to interchangeably display any one of a plurality of messages thereon.

SUMMARY OF THE INVENTION

The present invention relates to a door sign including parallel front and rear panels with a side panel perpendicularly disposed therebetween. The front and rear panels are sufficiently spaced to receive a door. The front panel includes an obliquely extending slot substantially aligned with a similar slot on the rear panel. Both the rear panel and front panel slots terminate at a side edge of the panel. The side panel includes an elongated opening for receiving a door knob latch and possibly a dead bolt latch. The sign may also include a variable message display means for selectively altering a message appearing on the sign. It is therefore an object of the present invention to provide a door sign which can be conveniently and securely attached to a door.

It is another object of the present invention to provide a door sign adapted to fit variably configured doors. It is yet another object of the present invention to provide a door sign designed to prevent removal by unauthorized persons. It is still another object of the present invention to provide a door sign having a variable message display means. Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
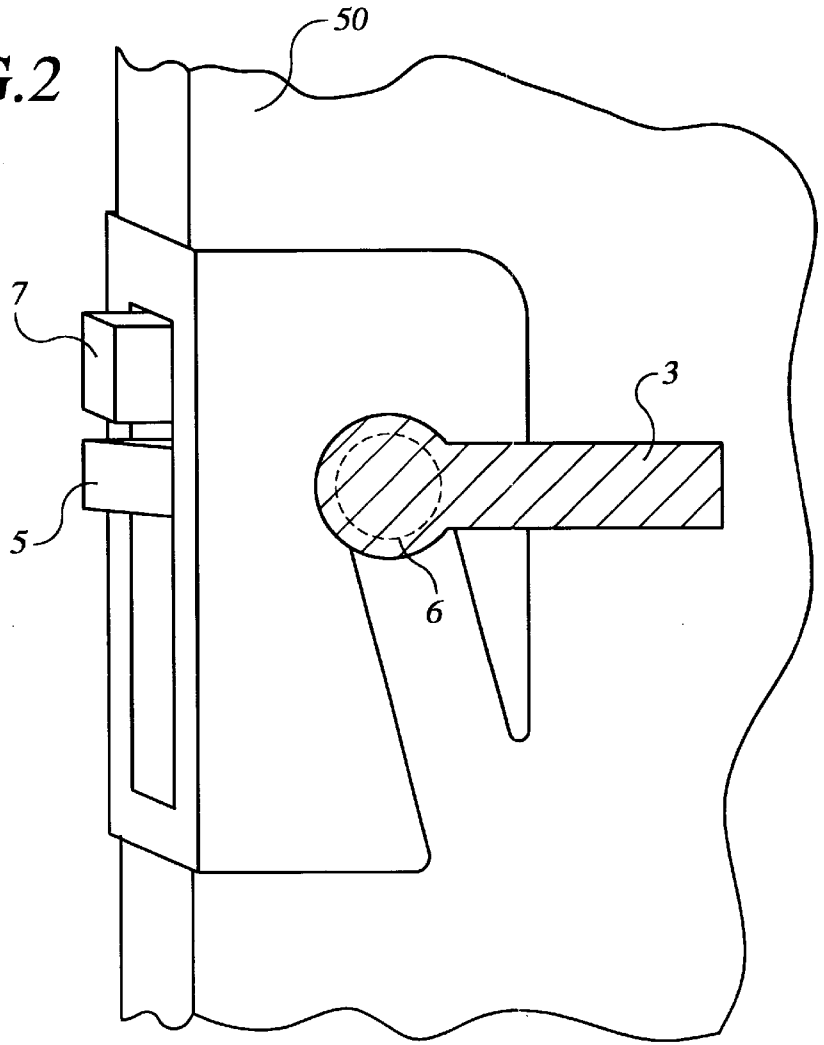
FIG. 2 is a perspective view of the door sign installed on a door.
Figure 1:
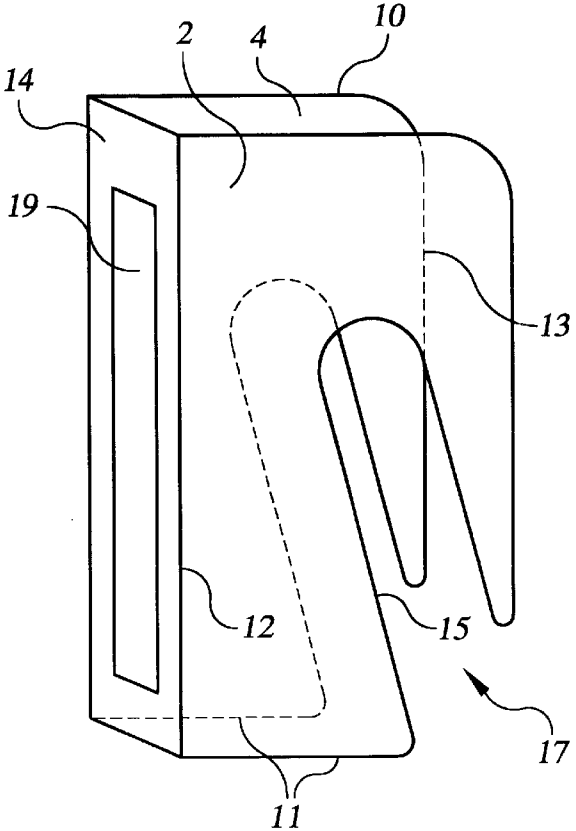
FIG. 1 is a perspective view of the door sign.

Referring now to FIGS. 1 and 2, the present invention relates to a door sign. A door 50 typically includes an exterior surface, an interior surface, a top edge, a bottom edge and a pair of side edges. Mounted on both the interior surface and exterior surface is a rotatable door handle 3 or knob that is operably connected to a retractable latch 5 extending from a side edge of the door. The door is often equipped with a deadbolt including a second latch 7 extending from a side edge of the door which may be selectively retracted therewithin.

The present invention relates to a door sign for securing to a door of the type described above. The sign includes a front panel 2 and a rear panel 4 with a side panel therebetween. The front and rear panels each include an upper edge 10, a lower edge 11, an outer side edge 12 and an inner side edge 13. The side panel 14 interconnects the inner side edges of the front and rear panels. When the sign is folded to an operable configuration as depicted in FIGS. 1 and 2, the front and rear panels are substantially parallel and are sufficiently spaced to receive the door therebetween.

Both the front and rear panels each include an obliquely extending slot 15 that extends from an intermediate portion of the panel to the outer side edge thereof at a position adjacent the lower edge. The slot terminates at an opening 17 into which a door knob shaft 6 is inserted. When the sign is folded to an operable configuration, the slots are substantially aligned.

The side panel includes an elongated, longitudinal opening 19 for receiving the door knob latch and possibly the dead bolt latch if the door is so equipped. Various indicia may be imprinted on the front or rear panels such as "Do Not Disturb", "Will Be Back Later", "Occupied", Vacant, "Dangerous Chemicals", etc.

Figure 3:
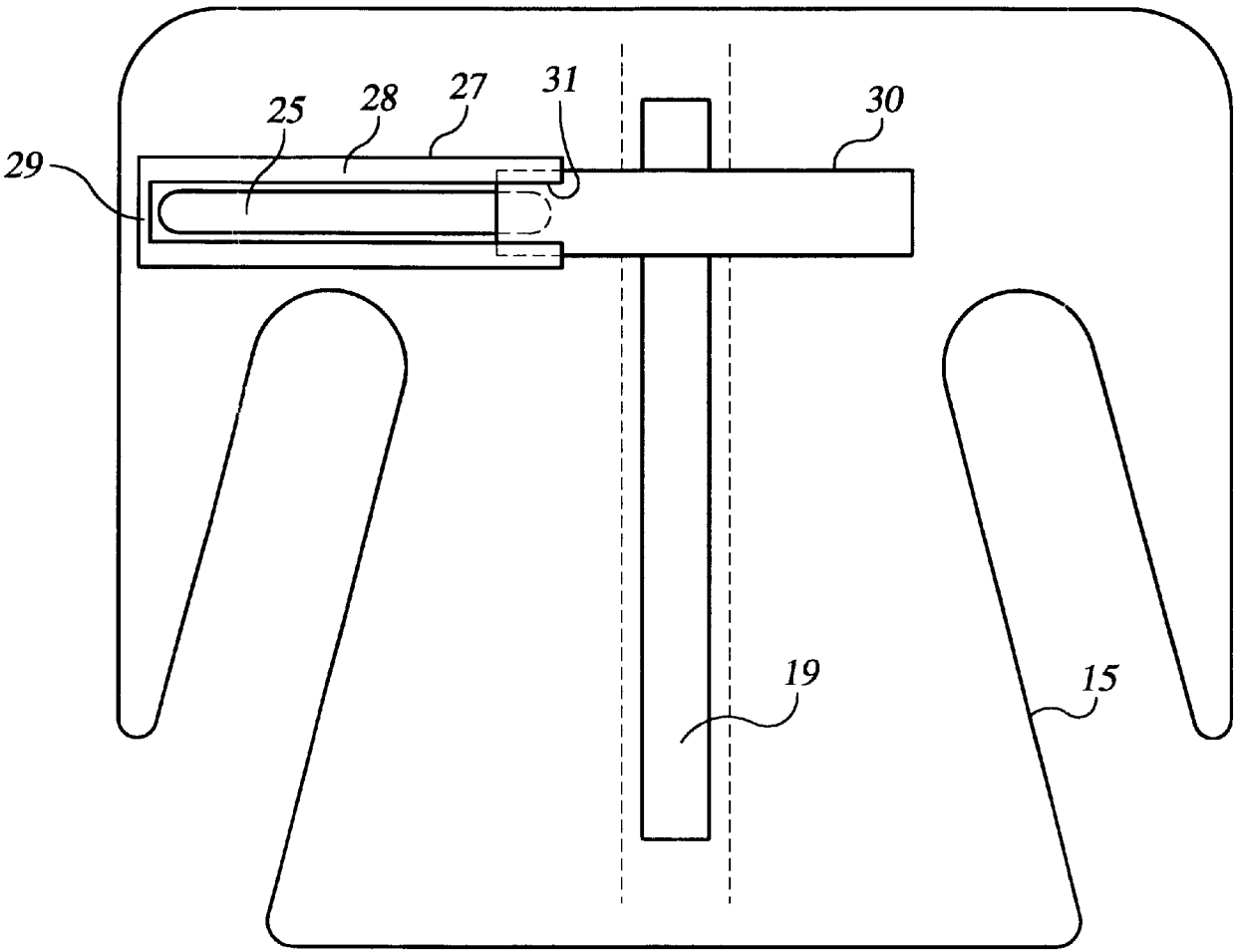
FIG. 3 depicts an alternative embodiment of the door sign according to the present invention with the sign in a flat, unfolded configuration.
Figure 4:
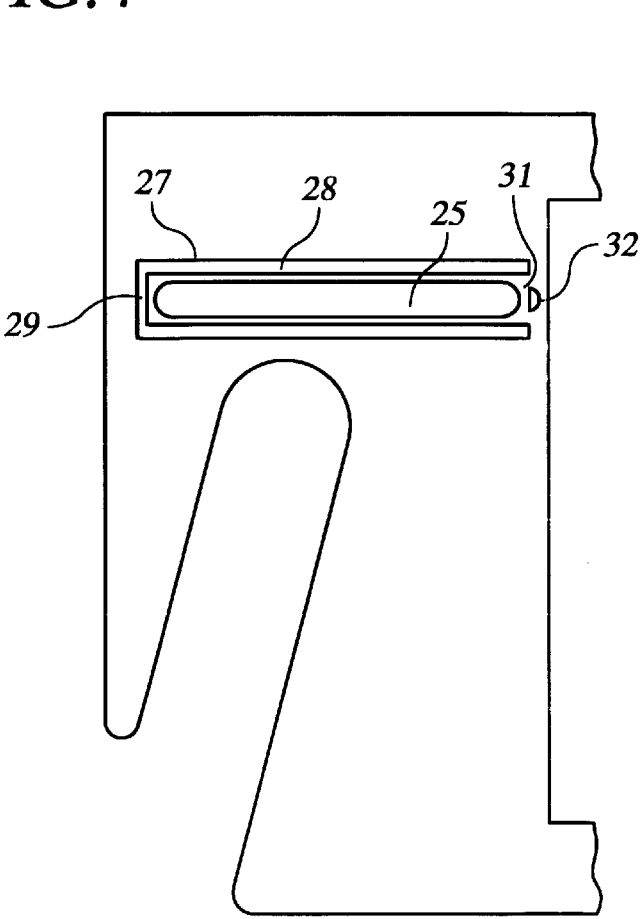
FIG. 4 depicts a slight variation of the device depicted in FIG. 3.
Figure 6:
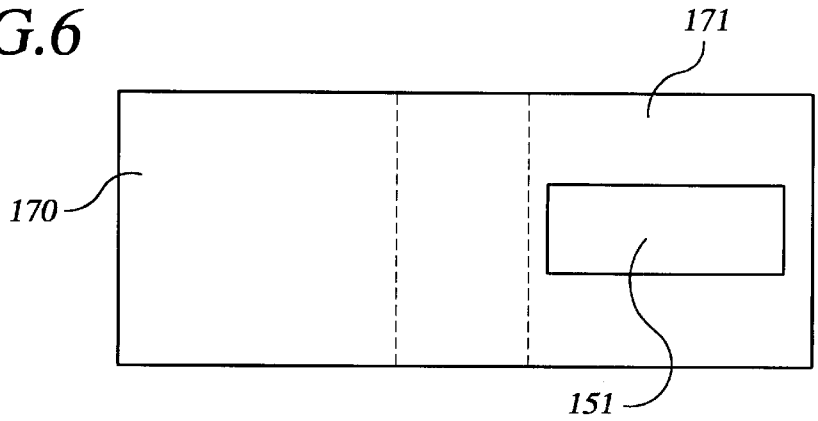
FIG. 6 depicts yet a fourth embodiment of the present invention with the sign in a flat, unfolded configuration.
Figure 7:
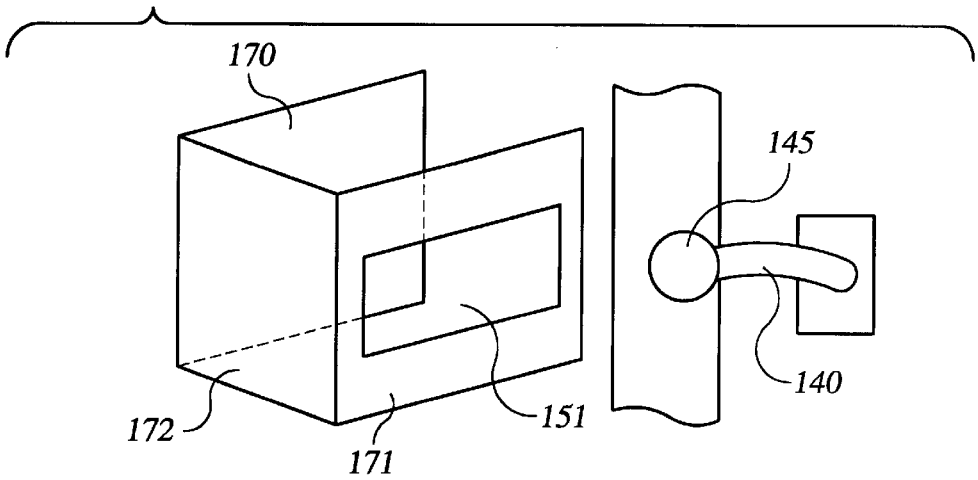
FIG. 7 depicts the embodiment shown in FIG. 6 in a folded, operable configuration.
Figure 8:
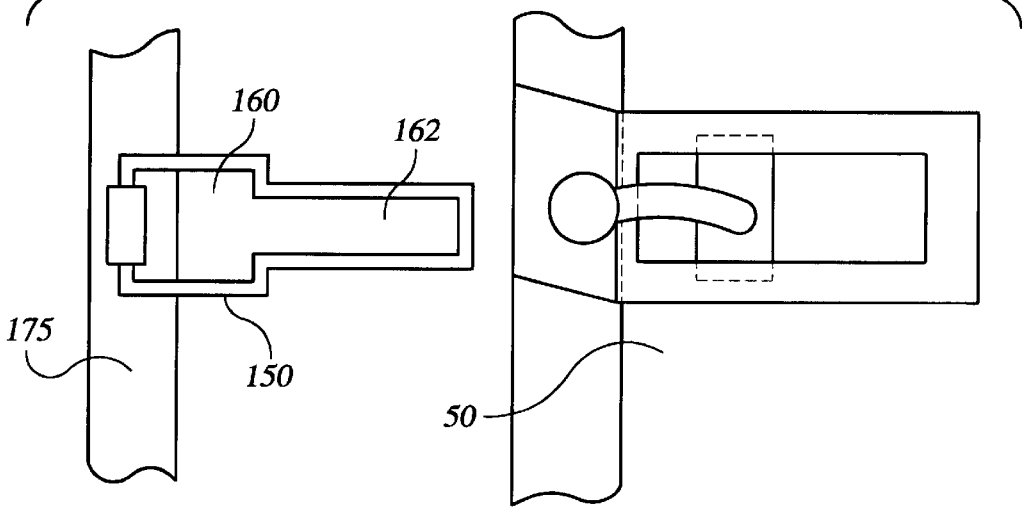
FIG. 8 depicts the sign shown in FIGS. 6 and 7 secured to a door.

Referring to FIGS. 3 and 4, instead of pre-printed indicia, the sign may include an interchangeable display means for selectively varying a message appearing on the sign. A first display means includes an elongated horizontal aperture 25 on the front panel. Mounted on the rear surface of the front panel and superimposed on the opening is a channel 27 defined by a pair of opposing L-shaped side walls 28 and an L-shaped end wall 29 therebetween. The channel slidably receives any one of a plurality of display placards 30 each having a discrete message imprinted on a side thereof. The end 31 of the channel opposite the end wall is open through which the placards are installed and removed. When the sign is folded and secured to a door as described below, the side panel obstructs the open end of the channel. In addition, the door frame will apply pressure to the sign thereby preventing a passerby from unfolding the sign to expose the open end of the channel. Furthermore, as depicted in FIG. 4, a raised tab 32 can be positioned adjacent the open end 31 to prevent the placard from inadvertently sliding out of the channel when the sign is in a flat or unfolded configuration. To remove a placard, the sign is bent slightly to form a crease between the tab and the open end until the tab is no longer obstructing access thereto.

Figure 5:
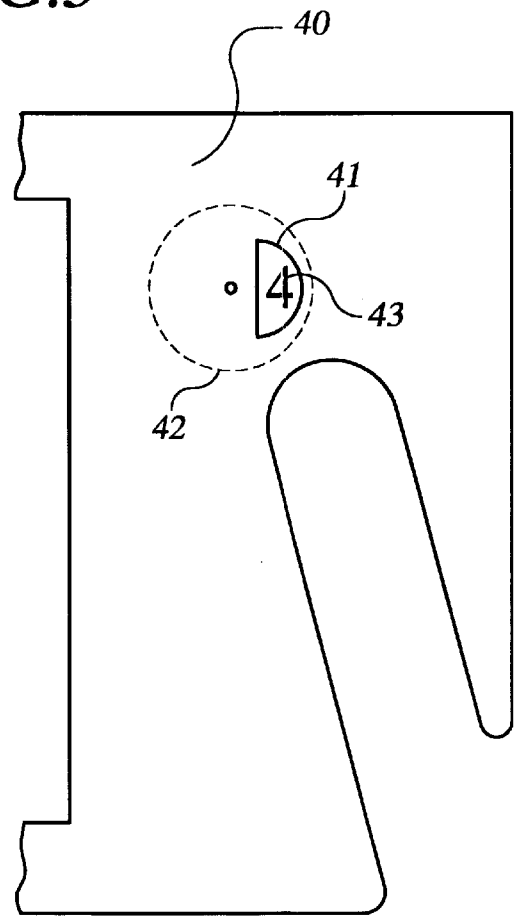
FIG. 5 is a partial cut-away view of yet a third embodiment according to the present invention.

Now referring to FIG. 5, the sign may alternatively include a second interchangeable display means 40. In this embodiment, the front panel includes an aperture 41 superimposed on a wheel 42 rotatably attached to the rear surface of the front panel. A plurality of discrete messages or indicia 43 are peripherally disposed on the wheel whereby a user can rotate the wheel to display a desired message within the aperture.

To secure the above described door signs to a door, a user opens the door and places the side panel against the inner side edge of the door with the dead bolt and door knob latches protruding through the side panel opening. The front and rear panels are placed against the front and rear surfaces of the door, respectively. The sign is then slid downwardly as far as possible with the front and rear door knob shafts being received within the oblique slots on the front and rear panels. The elongated opening and oblique slots allow the sign to be secured to the door regardless of the orientation of the latches relative to the door knobs. Preferably, the sign is positioned such that the sign is slid downwardly until each door knob shaft engages the upper end of a designated slot as depicted in FIG. 2. If, however, when the sign is so positioned and one or both of the latches are not protruding through the slot, the sign may be raised slightly until both latches are protruding. The door is then closed and preferably locked thereby securing the sign to the door. Furthermore, with certain door designs, the front or rear panel will overlay the door lock key receptacle thereby conspicuously displaying the message (i.e. Do Not Disturb) to those who may attempt to access a room using a key.

Now referring to FIGS. 5–8, a fourth embodiment is depicted for use with certain doors equipped with a safety lock more commonly found on hotel doors. The safety lock may include a chain mounted to the door frame 175 having a latch member at a distal end thereof. The Latch member slides within a horizontal channel mounted on the inner surface of the door. The latch member can only be removed from or inserted into the channel by completely closing the door. A second type of safety lock typically includes an arm 140 mounted to the inner surface of the door. The arm includes a catch member 145 at the distal end thereof. A retaining member 150 is pivotally mounted to the door frame and includes a larger opening 160 through which the catch member may pass and a smaller opening 162 through which the catch member cannot pass. The catch member can be inserted into or removed from the larger opening only when the door is completely closed. Both the types of safety locks allow a user inside a room to slightly open the door to see a person standing outside while preventing the person from forcing the door open or otherwise entering.

The sign according to the fourth embodiment is designed to secure to a door having one of the safety locks described above. Instead of slots on the front and rear panels and the opening on the side panel, the sign merely includes an opening 151 on either the front 170 or rear 171 panel for receiving the arm 140 or the channel on the door. As with the other embodiments, the front and rear panels are foldable relative to the side panel 172. Accordingly, the sign is wrapped around the door as described above with either the channel or arm positioned within the opening. The door is closed and the safety lock is engaged to securely fasten the sign to the door.

The above described sign may be constructed with any one of a variety of materials such as paper, vinyl, plastic, metal, or any other suitable material. If constructed with a pliable material, the sign can be unfolded to a flat configuration for transport or storage. Furthermore, the size, shape and color of the sign as well as the types of messages displayed thereon may be readily varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A door sign in combination with a door having a front surface and a rear surface, both said door front surface and rear surface each having a door knob and door knob shaft, said door further having an inner edge with a door latch thereon, said door sign comprising:

a front panel having an obliquely extending slot thereon wherein said slot on said front panel extends from an intermediate portion of said front panel to an outer edge thereof and terminates at an opening at a position adjacent a lower edge, said slot receiving said door knob shaft on the front surface of said door such that said door knob shaft engages an upper end of said slot;

a rear panel spaced from said front panel, said rear panel having an obliquely extending slot thereon wherein said slot on said rear panel extends from an intermediate portion of said rear panel to an outer edge thereof and terminates at an opening at a position adjacent a lower edge, said slot receiving the door knob shaft on the rear surface of said door such that said door knob shaft engages an upper end of said slot;

a side panel interconnecting said front and rear panels, said side panel including an elongated opening thereon, said opening receiving said door latch.

2. The combination according to claim 1 wherein each of said front and rear panels are foldable relative to said side panel allowing said sign to be folded between a flat configuration in which said panels are coplanar, and an operable configuration in which said front and rear panels are parallel with said side panel perpendicularly disposed therebetween and said slots on said front and rear panels are substantially aligned.

3. The combination according to claim 2 wherein said elongated opening is longitudinally disposed along said side panel for receiving said door latch and a dead bolt latch.

* * * * *